US009167922B1

(12) United States Patent
Holbrook et al.

(10) Patent No.: US 9,167,922 B1
(45) Date of Patent: Oct. 27, 2015

(54) PILLOW HAVING MESH INSERTS

(71) Applicant: Standard Fiber, LLC, Burlingame, CA (US)

(72) Inventors: Russ Holbrook, Matthews, NC (US); Chun Leung Chan, San Francisco, CA (US)

(73) Assignee: Standard Fiber, LLC, Burlingame, CA (US)

( * ) Notice: Subject to any disclaimer, the term of this patent is extended or adjusted under 35 U.S.C. 154(b) by 0 days.

(21) Appl. No.: 14/560,419

(22) Filed: Dec. 4, 2014

(51) Int. Cl.
*A47G 9/10* (2006.01)

(52) U.S. Cl.
CPC ..... *A47G 9/10* (2013.01); *A47G 2009/1018* (2013.01)

(58) Field of Classification Search
CPC ..... A47G 9/10; A47G 9/1036; A47G 9/1054; A47G 2009/1018
USPC ..... 5/636, 638, 652.1, 490; D6/601
See application file for complete search history.

(56) References Cited

U.S. PATENT DOCUMENTS

| | | | | |
|---|---|---|---|---|
| 1,876,591 | A | 9/1932 | Bawden | |
| 3,616,470 | A | 11/1971 | Young | |
| 4,445,241 | A | 5/1984 | Ender et al. | |
| 4,665,575 | A | 5/1987 | Raught | |
| 5,163,194 | A * | 11/1992 | Dixon | 5/636 |
| 5,388,296 | A | 2/1995 | Mansour | |
| 5,608,936 | A | 3/1997 | Nomura | |
| D448,229 | S * | 9/2001 | Su et al. | D6/601 |
| 6,408,468 | B1 * | 6/2002 | Comfort | 5/636 |
| 6,760,935 | B1 * | 7/2004 | Burton et al. | 5/645 |
| 7,107,638 | B2 | 9/2006 | Wilson | |
| 7,143,457 | B2 | 12/2006 | MacDonald | |
| 7,588,291 | B2 | 9/2009 | Gold et al. | |
| D604,550 | S * | 11/2009 | Carter | D6/601 |
| 8,393,025 | B2 | 3/2013 | Crispino et al. | |
| 8,646,134 | B1 * | 2/2014 | Alletto, Jr. | 5/636 |
| 8,745,793 | B2 | 6/2014 | Bensoussan | |
| 8,887,332 | B2 | 11/2014 | Alletto | |
| 2005/0193490 | A1 | 9/2005 | MacDonald | |
| 2006/0130235 | A1 | 6/2006 | Wilson | |
| 2008/0244832 | A1 | 10/2008 | Kuo | |
| 2009/0001801 | A1 | 1/2009 | Gold et al. | |
| 2010/0154122 | A1 | 6/2010 | Crispino et al. | |
| 2010/0235992 | A1 | 9/2010 | Bensoussan | |
| 2014/0096323 | A1 | 4/2014 | Alletto | |
| 2014/0196216 | A1 | 7/2014 | Weitzel et al. | |

* cited by examiner

*Primary Examiner* — Nicholas Polito
(74) *Attorney, Agent, or Firm* — Levenfeld Pearlstein, LLC

(57) ABSTRACT

A pillow and a pillow cover are provided. The pillow includes a cover layer defining an interior volume, the cover layer having a body portion and one or more mesh portions. The pillow further includes a filler material disposed in the interior volume. The interior volume is in fluid communication with the external atmosphere via the one or more mesh portions. The pillow cover includes a cover layer defining an interior volume. The interior volume is configured to receive the filler. The cover layer includes having a body portion and one or more mesh portions. The interior volume is in fluid communication with the external atmosphere via the one or more mesh portions.

7 Claims, 3 Drawing Sheets

PILLOW HAVING MESH INSERTS

BACKGROUND

The following description relates to a pillow, and in particular, a pillow having mesh inserts A pillow typically includes an outer layer or cover, such as a pillow shell, generally made of a fabric material. The outer layer defines in internal space configured to house a padding or filler material. The outer layer may include one or more pieces of fabric stitched around the inner padding or filler material. Further, or alternatively, the outer layer may include a zipper, slide fastener or other similar fastener along at least a portion of one or more sides to selectively provide or restrict access to the internal space.

The fabric of the outer layer may be generally homogenous such that similar properties are found across the outer layer. For example, the fabric may have generally the same stiffness, softness and/or density across the outer layer. Accordingly, a breathability of the fabric, i.e., an ability to allow air to flow between the internal space and external atmosphere may be generally constant across the outer layer.

In use, a person may lean, lie, sit or otherwise support a portion of their body on or against the pillow. Heat from the person may be transferred to the pillow via contact between the person and the outer layer. With limited or restricted breathability through the outer layer, i.e., with limited airflow through the outer layer, the heat may be retained by the pillow, both in the outer layer and the inner padding or filler. As result, a temperature of the pillow may increase to a point where it causes discomfort for the person using the pillow, particularly at a location where the person is in contact with the pillow.

Accordingly, it is desirable to provide a pillow that allows for increased breathability, i.e., airflow through the outer layer, to limit or prevent an increase in temperature of the pillow.

SUMMARY

According to one aspect, there is provided a pillow. The pillow includes a cover layer defining an inner volume, the cover layer having a body portion and one or more mesh portions. The pillow further includes a filler material disposed in the inner volume. The inner volume is in fluid communication with external atmosphere via the one or more mesh portions.

According to another aspect, there is provided a pillow cover. The pillow cover includes a cover layer defining an inner volume, the inner volume configured to receive a filler. The cover layer includes a body portion and one or more mesh portions. The inner volume is in fluid communication with external atmosphere via the one or more mesh portions.

Other objects, features, and advantages of the disclosure will be apparent from the following description, taken in conjunction with the accompanying sheets of drawings, wherein like numerals refer to like parts, elements, components, steps, and processes.

DETAILED DESCRIPTION

Figure 1:
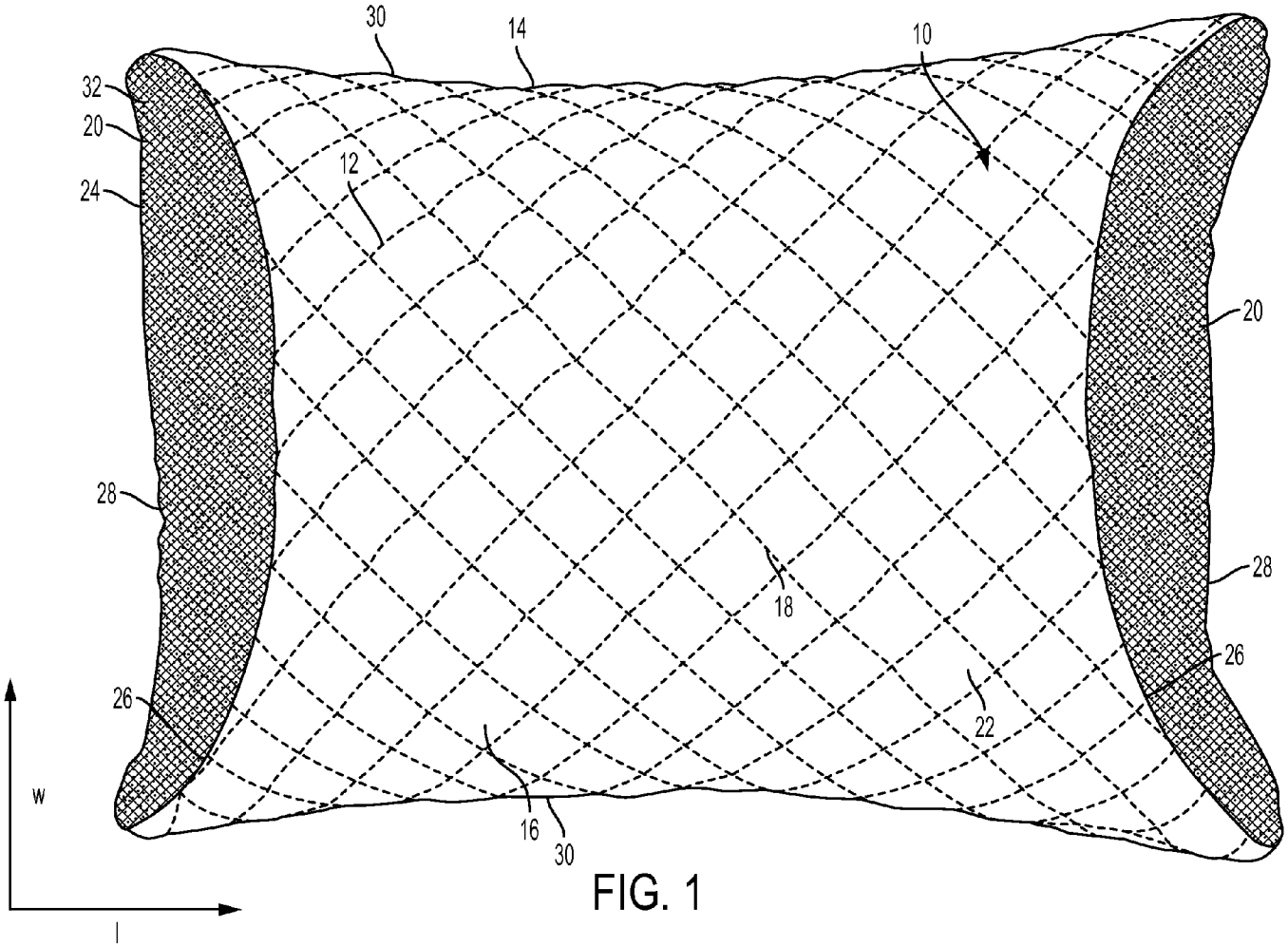
FIG. 1 is a top view of an example of a pillow according to an embodiment disclosed herein.

While the present disclosure is susceptible of embodiment in various forms, there is shown in the drawings and will hereinafter be described one or more embodiments with the understanding that the present disclosure is to be considered illustrative only and is not intended to limit the disclosure to any specific embodiment described or illustrated.

Figure 2:
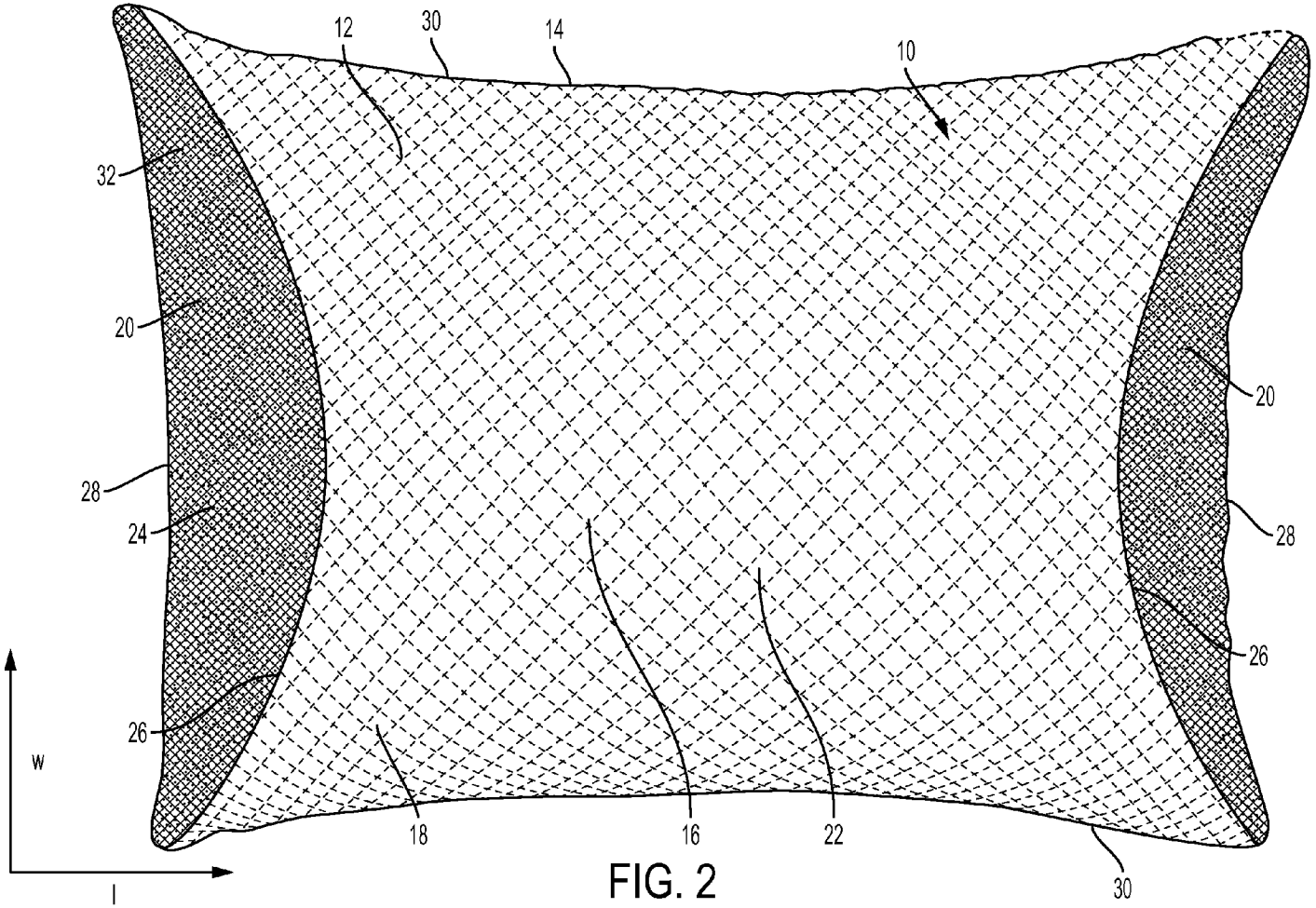
FIG. 2 is a top view of another example of a pillow according to an embodiment disclosed herein.
Figure 3:
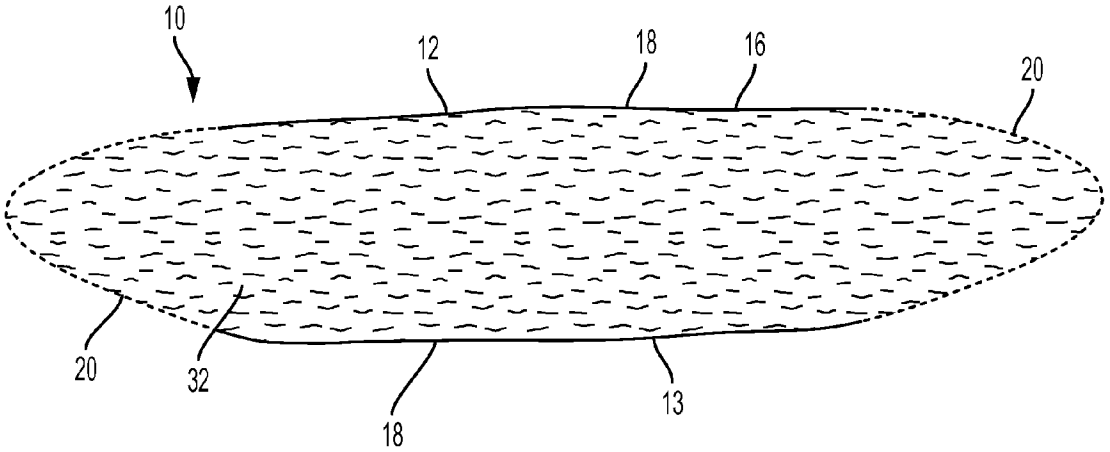
FIG. 3 is a cross-sectional view of the pillow of FIG. 1, according to an embodiment disclosed herein.

FIG. 1 is top view of a pillow 10 according to an embodiment described herein. FIG. 2 is a top view showing a variation of the pillow 10 of FIG. 1, and FIG. 3 is a cross-sectional view of the pillow 10 of FIG. 1 according to an embodiment described herein. Referring to FIGS. 1-3, the pillow 10 has a first side 12, a second side 13 opposite to the first side 12, and a peripheral edge region 14 extending about a periphery of the pillow 10 at a boundary between the first side 12 and second side 13. In one embodiment, the first side 12 is a top side of the pillow 10 and the second side 13 is a bottom side. An interior volume is defined within the first side 12, the second side 13 and the peripheral edge region 14.

The pillow 10 includes an outer or cover layer 16 defining the interior volume. The cover layer 16 extends across the first side 12, the second side 13 and the peripheral edge region 14. In one embodiment, the cover layer 16 includes a body portion 18 and one or more mesh portions 20. The body portion 18 may be constructed of one or more panels of material. For example, a single panel of material may extend substantially about the interior volume and may have opposing ends secured together, directly or indirectly. In another embodiment, the body portion 18 may be constructed of multiple panels. For example, the body portion 18 may be constructed of two panels that are secured to one another. In one embodiment, opposite edges of one panel may be secured to corresponding opposite edges of the other panel. It is understood that the body portion 18 may include additional panels as well, and that the panels may be secured to another at non-edge areas of the pillow 10. The one or more panels may be secured to one another, for example, by stitching, buttons, snaps, a slide fastener, a hook and loop fastener and the like.

In addition, the one or more panels of the body portion 18 may be formed having one or more plies of material. In one embodiment, the body portion 18 may be quilted. That is, in one embodiment, the body portion 18 may include, for example, two plies of material that are stitched together to form a plurality of boxes 22 or interior spaces between the plies. The boxes 22 may be filled with a cushioning material. The size, shape, volume and/or pattern of the boxes 22 may be varied. For example, as shown in FIG. 1, in one embodiment, the boxes 22 may be formed in a large square or diamond pattern, while in another example, as shown in FIG. 2, the boxes 22 may be formed in a small square or diamond pattern. The box patterns are defined by a stitching pattern in the plies of material. It is understood that other shapes or patterns may be formed in each panel by varying or changing the stitching pattern in the plies of material, and that the present disclosure in not limited to the square or diamond box patterns shown in the figures. In other embodiments, the body portion 18 may be formed by one or more panels having only a single ply that is not quilted, or a combination of single ply, multiple ply, quilted and/or non-quilted sections.

With further reference to FIGS. 1 and 2, the one or more mesh portions 20 include a plurality of openings 24. In one embodiment, the openings 24 are of a predetermined size and shape and are positioned at predetermined positions along the one or more mesh portions 20. In one embodiment, the openings 24 are positioned at regular, consistently spaced intervals along the one or more mesh portions 20. That is, equal spacing may exist between each opening 24 and the nearest adjacent opening or openings 24. The openings 24 may all be similarly shaped and sized. Alternatively, the one or more mesh portions 20 may be manufactured with openings 24 having predetermined sizes and shapes that vary among one another. Accordingly, the one or more mesh portions 20 are configured to allow an increased flow of air into and out of the interior volume, per unit area, than the body portion 18. The cover layer 16, including the body portion 18 and the one or more mesh portions 20 may be made from, for example, a fabric material, such as a knitted fabric, a sateen weave, or any flat weave fabric. In some embodiments, the one or more mesh portions 20 may also, or alternatively, be made from nylon, polyester or another similar material.

The one or more mesh portions 20 may be secured to the body portion 18, for example, by stitching. In one embodiment, the one or mesh portions 20 may include two mesh portions. As shown in FIGS. 1 and 2, the mesh portions 20 may be positioned at opposite ends of the pillow 10 spaced apart by the body portion 18. In one embodiment, the mesh portions 20 may extend along a width direction 'w' of the pillow 10, and are spaced apart along a length direction '1' of the pillow 10. However, it is understood that the present disclosure is not limited to this configuration, and that the mesh portions 20 may also, for example, extend along the length direction '1' of the pillow 10 and be spaced apart in the width direction 'w' of the pillow 10.

With further reference to FIGS. 1 and 2, the one or more mesh portions 20 may include a proximate edge 26 that is inwardly curved, i.e., curved toward a center of the cover layer 16. In some embodiments, the inwardly curved edge 26 may be secured directly to the body portion 18, for example, by stitching. In addition, each mesh portion 20 may extend to an outer, distal edge 28 that extends generally along a portion of the peripheral edge region 14 of the pillow 10. For example, in one embodiment, the distal edges 28 may extend generally in the width direction 'w' at opposite peripheral edge regions 14 of the pillow 10. Each distal side 28 may be curved inwardly toward a center of the body portion 18. Alternatively, each distal side 28 may be substantially linear. In one embodiment, the mesh portions 20, when viewed together, may be substantially hourglass shaped. That is, when viewed as a whole, the mesh portions 20 may form a shape having a dimension at opposite ends that is greater than a dimension in the same direction at a point between the opposite ends.

It is understood that in other embodiments, the cover layer 16 may include additional mesh portions 20, connected to one another, or discretely positioned, i.e., spaced apart, along the cover layer 16. The number, size, shape and position of the mesh portions 20, and the number, size, shape, and position of the openings 24 may be varied during manufacturing and assembly to provide different airflow characteristics between the interior volume and the external atmosphere outside of the cover layer 16.

The body portion 18 may also include two opposed inwardly curved edges 30, curved toward a center of the cover layer 16. In one embodiment, the opposed inwardly curved sides 30 may extend generally in the length direction '1', between the distal edges 28, and be positioned along portions of the peripheral edge region 14 of the pillow 10. Accordingly, the pillow 10 may be substantially hourglass shaped along the length direction '1'.

The cover layer 16 may be formed similarly on the first side 12 and second side 13 of the pillow 10. In one embodiment, the mesh portions 20 extend from respective curved edges 26 on the first side 12 of the pillow 10 to respective distal edges 28 at the peripheral edge region 14, and around to a second curved edge (not shown) on the second side 13 of the pillow 10, such that the second side 13 of the pillow 10 is substantially identical to the first side 12 of the pillow 10. However, the present disclosure is not limited this configuration. For example, the second side 13 may be formed in its entirety as a body portion 18. That is the one or more mesh portions 20 may only be positioned on a first side 12.

As best shown in FIG. 3, the pillow 10 further includes a padding or filler material 32 disposed in the interior volume, i.e., with the cover layer 16. The filler material 32 may be, for example a fibrous or foam material. In one embodiment, the filler material 32 may be a polyester fiber.

In the embodiments above, the pillow 10 includes the one or more mesh portions 20 having openings 24 formed therein to allow for increased airflow between the interior volume and the external atmosphere outside of the cover layer 16. In one embodiment, opposite distal edges 28 of the pillow 10 are flared outwardly away from a center of the pillow 10. The flared distal edges 28 of the pillow 10 serve to increase a surface area or profile of the pillow 10. Thus, by positioning the mesh portions 20 at the opposite flared edges 28, a larger mesh area may be provided, which may allow for increased airflow into and out of the interior volume of pillow 10. Increased airflow may serve to cool, or limit heat buildup in the pillow 10.

The pillow 10 is shaped so that, in use, a person may rest or otherwise be supported at or near a center of the pillow. The inwardly curved edges 30 of the body portion 18 may reduce, limit or prevent interference of the pillow with other portions of the person's body, such as the person's neck or shoulders. By positioning the mesh portions 20 at opposite ends, the mesh portions 20 may remain unobstructed by a person using the pillow, thereby allowing for unobstructed airflow through the openings 24.

Further still, the body portion 18, positioned between the mesh portions 20, is configured for contact with the person. Thus, the body portion 18 may be formed or constructed having, for example, different, cushioning, softness and stiffness characteristics than the mesh portions 20. For example, as detailed above, the body portion 18 may be quilted. Because sufficient airflow between the interior volume and the external atmosphere may be provided at the one or more mesh portions 20, in some embodiments, the body portion 18 may be made from materials or constructed in a way to enhance certain characteristics, including cushioning, softness and stiffness, that may restrict breathability through the body portion 18.

Accordingly, in the embodiments above, the cover layer 16 may be sufficiently breathable so as to limit or prevent increases in temperature that a user may consider uncomfortable. Moreover, the cover layer 16, including the one or more mesh portions 20 may be ergonomically shaped. For example, the pillow 10 may include curved edges 26, 28 at the one or more mesh portions 20, and curved edges 30 at the body portion 18. In addition, the one or more mesh portions 20, in some embodiments, are positioned toward or at opposing edges of the cover layer 16, while the body portion 18 extends between the mesh portions 20. Accordingly, a user may rest, lie, or otherwise be supported on the body portion 18, which may be quilted for increased comfort, without affecting or restricting airflow through the one or more mesh portions 20.

It should also be understood that various changes and modifications to the presently disclosed embodiments will be apparent to those skilled in the art. Such changes and modifications can be made without departing from the spirit and scope of the present disclosure and without diminishing its intended advantages. It is therefore intended that such changes and modifications be covered by the appended claims.

The invention claimed is:

1. A pillow comprising:

a cover layer defining an interior volume, the cover layer having a top side, a bottom side, and opposed longitudinal edges and opposed transverse edges defining an outer periphery extending along a boundary of the top side and the bottom side, the longitudinal edges inwardly curved so as to vary a width of the pillow along a longitudinal direction in a plan view, the cover layer further having a body portion and one or more mesh portions positioned on the top side and the bottom side; and a filler material disposed in the interior volume, wherein the filler material is in fluid communication with the external atmosphere via the one or more mesh portions, and the one or more mesh portions includes two mesh portions discretely formed and spaced apart by the body portion on the top side and the bottom side, each mesh portion having an inwardly curved proximate edge secured to the body portion and a distal edge at a corresponding transverse edge of the opposed transverse edges, and wherein the top side is secured directly to the bottom side at the outer periphery.

2. The pillow of claim 1, wherein the body portion is made from a quilted fabric.

3. The pillow of claim 1, wherein the body portion is made from a knitted fabric, sateen weave or flat weave fabric.

4. The pillow of claim 1, wherein the filler material is polyester.

5. A pillow cover comprising:

a cover layer defining an interior volume, the cover layer having a top side, a bottom side, and opposed longitudinal edges and opposed transverse edges defining an outer periphery extending along a boundary of the top side and the bottom side, the longitudinal edges inwardly curved so as to vary a width of the pillow cover along a longitudinal direction in a plan view, the cover layer further having a body portion an one or more mesh portions positioned on the top side and the bottom side, wherein the interior volume is in fluid communication with the external atmosphere via the one or more mesh portions, and the one or more mesh portions includes two mesh portions discretely formed and spaced apart by the body portion on the top side and the bottom side, each mesh portion having an inwardly curved proximate edge secured to the body portion and a distal edge at a corresponding transverse edge of the opposed transverse edges, and wherein the top side is secured directly to the bottom side at the outer periphery.

6. The pillow cover of claim 5, wherein the body portion is made from a quilted fabric.

7. The pillow cover of claim 5, wherein the body portion is made from a knitted fabric, sateen weave or flat weave fabric.

* * * * *